US010669068B2

(12) United States Patent
Burns et al.

(10) Patent No.: US 10,669,068 B2
(45) Date of Patent: Jun. 2, 2020

(54) BOTTLE WITH OPEN LOOP HANDLE

(71) Applicant: Can't Live Without It, LLC, New York, NY (US)

(72) Inventors: Clay Allen Burns, New York, NY (US); Sarah Kauss, New York, NY (US); James Best, Hewitt, NJ (US); Michael Circosta, Brooklyn, NY (US)

(73) Assignee: CAN'T LIVE WITHOUT IT, LLC, New York, NY (US)

( * ) Notice: Subject to any disclaimer, the term of this patent is extended or adjusted under 35 U.S.C. 154(b) by 0 days.

(21) Appl. No.: 15/421,363

(22) Filed: Jan. 31, 2017

(65) Prior Publication Data

US 2018/0215506 A1 Aug. 2, 2018

(51) Int. Cl.

| | |
|---|---|
| ***B65D 23/10*** | (2006.01) |
| ***A45F 5/00*** | (2006.01) |
| ***A45F 3/16*** | (2006.01) |
| ***B65D 1/02*** | (2006.01) |
| ***B65D 41/02*** | (2006.01) |

(52) U.S. Cl.

CPC ..... *B65D 23/104* (2013.01); *A45F 3/16* (2013.01); *A45F 5/00* (2013.01); *B65D 1/0246* (2013.01); *B65D 1/0284* (2013.01); *B65D 23/108* (2013.01); *B65D 41/02* (2013.01); *A45F 2200/0583* (2013.01)

(58) Field of Classification Search

CPC .... B65D 23/104; B65D 1/0284; B65D 41/02; B65D 1/0246; B65D 23/106; B65D 25/28; B65D 25/32; B65D 25/324; A61J 1/16; Y10T 16/44

USPC .... 220/694–702, 710.5, 737, 741, 751, 752, 220/755, 759, 768, 776; 215/396

See application file for complete search history.

(56) References Cited

U.S. PATENT DOCUMENTS

| | | | | |
|---|---|---|---|---|
| 3,311,252 A | | 3/1967 | Swartwood et all. | |
| 3,643,829 A | | 2/1972 | Lachner | |
| 4,310,102 A | | 1/1982 | Walter | |
| 5,667,265 A | * | 9/1997 | Gebhard | B65D 23/108 294/169 |

(Continued)

FOREIGN PATENT DOCUMENTS

| | | |
|---|---|---|
| CN | 202464499 | 10/2012 |
| CN | 202642309 | 2/2013 |

(Continued)

OTHER PUBLICATIONS

Glass Milk Bottle; http://betterbeveragebottles.com/17-oz-glass-water-bottle-virtually-unbreakable-with-thick-sides/.

(Continued)

*Primary Examiner* — Anthony D Stashick
*Assistant Examiner* — James M Van Buskirk
(74) *Attorney, Agent, or Firm* — Kilpatrick Townsend & Stockton LLP

(57) ABSTRACT

A beverage bottle may include a handle that engages a neck of the bottle. The handle may include a band region that encircles a portion of the neck of the bottle. The handle may be easily assembled onto the bottle, and be aesthetically pleasing. In an embodiment, a grip portion may be aligned angularly higher than the band region when the bottle is resting in a vertical position. The handle may have a grip portion sized to enable an adult to comfortably hold the grip portion with at least one finger.

27 Claims, 14 Drawing Sheets

(56) References Cited

U.S. PATENT DOCUMENTS

| | | | | |
|---|---|---|---|---|
| 5,816,631 | A * | 10/1998 | Kochan | B65D 23/106 294/33 |
| 6,352,235 | B2 * | 3/2002 | Cizek | B65D 23/106 215/398 |
| D456,266 | S | 4/2002 | Cross et al. | |
| D571,665 | S | 6/2008 | Sanders | |
| D611,833 | S | 3/2010 | Taylor et al. | |
| D655,136 | S | 3/2012 | Goodman | |
| 8,561,834 | B2 * | 10/2013 | Ziegler | A47G 23/0233 220/212.5 |
| 2002/0066758 | A1 * | 6/2002 | Fadal, II | A45F 3/16 224/148.7 |
| 2006/0261027 | A1 * | 11/2006 | Denis | B29C 49/0042 215/27 |
| 2007/0272651 | A1 | 11/2007 | Dipasquale et al. | |
| 2009/0014454 | A1 * | 1/2009 | Nelson | B65D 23/106 220/758 |
| 2013/0008915 | A1 * | 1/2013 | Dorn | A45F 5/102 220/755 |
| 2015/0251811 | A1 | 9/2015 | Glaser et al. | |
| 2016/0368650 | A1 * | 12/2016 | Davis | B65D 1/0246 |

FOREIGN PATENT DOCUMENTS

| | | |
|---|---|---|
| CN | 103482182 | 1/2014 |
| CN | 103826979 | 5/2014 |
| DE | 202004008711 | 9/2004 |
| DE | 202008007805 | 10/2008 |

OTHER PUBLICATIONS

Glass Milk Bottle Plastic Handles; http://www.redhillgeneralstore.com/housewares/kitchen/kitacc/Glass-Milk-Bottles.htm.
Water Bottle Polycarbonate; http://www.ebay.com/itm/Water-Bottle-Polycarbonate-Natural-Blue-1-89-L-64-oz-Square-With-Red-Handle-USA-/301088813816.
Metal Water Storage Bottle with Handle; http://www.ebay.com/itm/Metal-Water-Storage-Bottle-With-Handle-/262572399593.
AquaFlask; http://www.theaquaflask.com/shop-2/aquaflask-insulated-double-wall-stainless-steel-water-bottle-with-handle-27-ounce-glossy-stainless-steel.
Personalized Stainless Steel Water Bottles; https://ecopromotionsonline.com/products/bpa-free-drinkware-reusable-water-bottles-new-eco-friendly-products/personalized-stainles-0.
Goodlife Water Bottle; http://travel.spotcoolstuff.com/water-bottle-review-comparison/goodlife-sigg-nalgene-gaiam-kor-one.
Stainless Steel Sports Bottle; http://www.diytrade.com/china/pd/7276391/Double_wall_Stainless_Steel_Sports_Bottle.html.
Chilly's Bottle; https://www.chillysbottles.com/.
Brimmalife; http://brimmalife.com/collections/frontpage/products/brimma-17-oz-stainless-steel-water-bottle.
Bottle "A" identified prior to Nov. 18, 2016.
Bottle "B" identified prior to Nov. 18, 2016.
Bottle "C" identified prior to Nov. 18, 2016.
Bottle "D" identified prior to Nov. 18, 2016.
Bottle "E" identified prior to Nov. 18, 2016.
Bottle "F" identified prior to Nov. 18, 2016.
Bottle "G" identified prior to Nov. 18, 2016.
Bottle "H" identified prior to Nov. 18, 2016.
Bottle "I" identified prior to Nov. 18, 2016.
Bottle "J" identified prior to Nov. 18, 2016.
Bottle "K" identified prior to Nov. 18, 2016.
Bottle "L" identified prior to Nov. 18, 2016.
CA 2,983,871, "Office Action," dated Aug. 2, 2018, 3 pages.
EP Application No. 17186746.8 , "Extended European Search Report," dated Jul. 11, 2018, 10 pages.
EP Application No. 17186746.8 , "Partial European Search Report," dated Apr. 5, 2018, 11 pages.
CA 2,983,871, "Office Action," dated Apr. 12, 2019, 6 pages.
CN201710222536.1, "Office Action," dated Dec. 4, 2019 (3 pages of English Translation, 9 pages of Chinese Translation).

* cited by examiner

BOTTLE WITH OPEN LOOP HANDLE

BACKGROUND OF THE INVENTION

Bottles are a very common drinking vessel, and are particularly useful for individuals to transport fluids, such as water and coffee. However, carrying and pouring from bottles can sometimes pose challenges for the user. When carrying a bottle, the addition of a handle can add comfort and extend the time period over which carrying the bottle will remain easy and comfortable. Further, in situations where a user only has one hand available, such as when the user is simultaneously engaged in another activity with one hand (e.g., carrying something else), a handle may make carrying the bottle easier. Additionally, a handle attached to the neck of the bottle may provide a secure grip and ergonomic aid for tilting and pouring contents from the bottle into a cup or other vessel with maximum ease, accuracy, and comfort.

SUMMARY OF THE INVENTION

To provide for a more easily handled beverage bottle, a handle that engages a neck of a bottle may be used. The handle may provide a certain handling or gripping comfort to a user to carry the bottle, be easily assembled onto the bottle, and be aesthetically pleasing. The handle may have a grip portion sized to enable an adult to comfortably hold the grip portion with at least one finger. The handle may be stiff or flexible, but by using an angular curve along the handle between the bottle and grip portion, the handle may provide visual cue as to the grip area and may maximize for the user's finger(s) to interact with the handle.

To simplify assembly of the handle onto a neck of the bottle, a band region of the handle may wrap around and engage the neck of the bottle with a circumference less than 360 degrees, such as about 270 degrees such that the handle has sufficient attachment area to be affixed securely to the bottle. The attachment area may allow the handle to be attached to the bottle without the use of fasteners, which are costly and impractical in a thin-walled bottle, and without overly stretching the material of the handle, thereby accommodating the use of traditionally stiff materials, such as aluminum or rigid plastics. The neck of the bottle may be configured with a groove for locating and securing the portion of the handle band that contacts the bottle. The groove may be further configured with registration features such that corresponding registration features on the band region of the handle may prevent rotation or translation of the handle relative to the bottle. The registration features may be an indentation. In an embodiment, the indentation may be a circumferential indentation or partial circumferential indentation. In an alternative embodiment, the registration feature may be a protrusion, such as a circumferential protrusion or partial circumferential protrusion.

One embodiment of a beverage container may include a first end that defines a base and a second end that defines an opening. A sidewall may extend between the first end and second end. A neck may be disposed between the sidewall and second end. A handle may include a band region that encircles the neck less than 360°, and a first pair of transition points at which respective sides of the band region transition to extend radially from the neck. A first lateral region and a second lateral region may respectively extend radially from the first pair of transition points. A second pair of transition points may be located along the lateral regions at which the lateral regions transition from a lateral direction toward a longitudinal direction. A grip region may extend between the pair of lateral regions.

One embodiment of a method for assembling a beverage container may include placing a handle mounting member around a finish of the beverage container. The handle may include a semi-circular portion sized to fit onto a neck of the beverage container. The semi-circular portion of the handle may be slid over the handle mounting member and onto the neck of the beverage container. The handle mounting member may thereafter be removed from the neck.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Figures 1A, 1B:
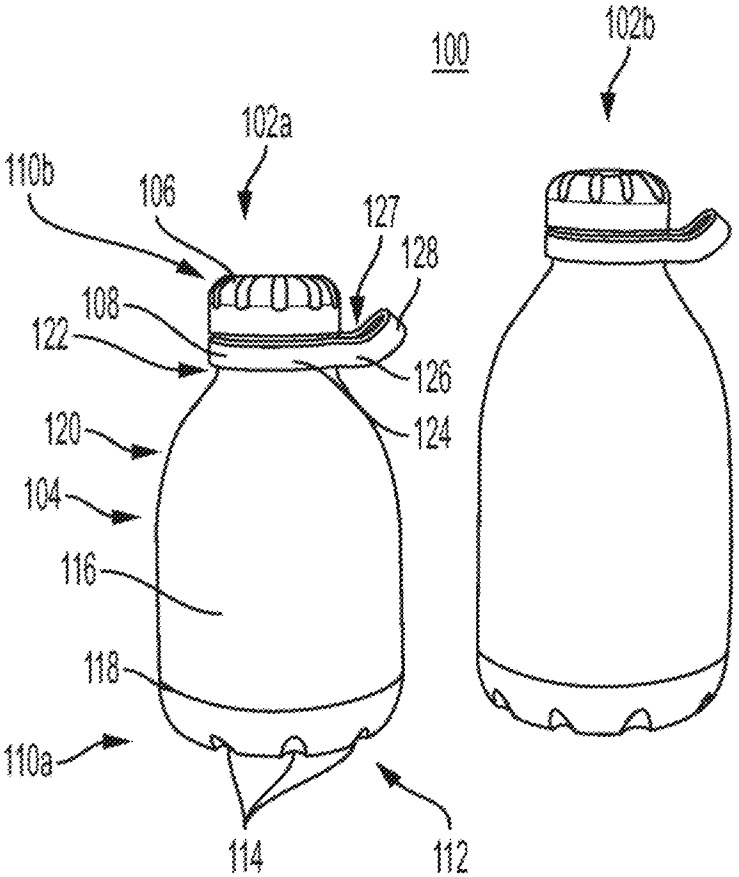
FIGS. 1A and 1B are illustrations of illustrative embodiments of a beverage bottle with an illustrative handle.

Referring to FIGS. 1A and 1B, illustrations of illustrative first and second embodiments 100 of a first bottle or beverage container 102*a* and a second bottle or beverage container 102*b* are shown. The beverage containers 102*a* and 102*b* (collectively 102) shown differ from each other in size and other dimensions. With regard to FIG. 2A, in an embodiment, the beverage container 102*a* may include a bottle portion 104, a bottle cap 106, and a handle 108. In an embodiment, the bottle portion 104 may have a generally cylindrical shape. Alternative embodiments of the bottle 102*a* may include circular, elliptical, square, rectangular, or any other geometric shape. The bottle portion 104 may include a first end 110*a* and a second end 110*b*. The second end 110*b* is configured to define an opening (not shown) of the bottle 102*a* for fluid to enter and exit the beverage containers 102. The first end 110*a* defines a base 112, and in an embodiment, may include flutes 114 that are both decorative and strengthen the base 112. The base 112, as shown, may further be defined by base-defining line 118. A sidewall 116 may be configured to extend between the first end 110*a* and the second end 110*b*. A shoulder 120 may provide a taper of the sidewall 116 to a smaller cross-sectional area or neck 122 of the bottle 104. Alternatively, the shoulder 120 may define a non-gradual or discontinuous transition. The neck 122 may extend from the shoulder 120 to a finish (e.g., lip of bottle, threaded region) at the second end 110*b*.

The handle 108 may be engaged or attached to the neck 122 of the bottle portion 104, and may include a band region 124 encircling less than 360° (i.e., semi-circular) (see FIG. 2C), a pair of lateral regions 126 that extends from the band region 124 laterally from the neck 122, and a grip region 128 connecting the pair of lateral regions 126. The band region 124 may have a height of between about 3 mm and about 50 mm. Moreover, the band region may have a thickness between about 2 mm and about 10 mm. Other dimensions of the height and thickness may be utilized, as well, depending on the size of the bottle 102*a*. In attaching the handle 108 to the neck 122, a groove or partial groove may be used to snap or otherwise secure the handle onto the neck, wherein the tensile strength of the handle band provides a necessary force to retain the handle in the groove. Alternatively, a friction fit, connection features in the band region 124 and neck 122, connection or carry ring or other feature of the neck 122, adhesives, epoxies, screws, or otherwise may prevent separation of the handle 108 from the neck 122 of the bottle portion 104.

The extension of the lateral regions 126 away from the neck 122 may create a gap 127 between the neck 122 and grip region 128 sufficiently large enough for at least one finger of an adult to be extended therethrough. In an embodiment, more than one finger may be accommodated to increase comfort and ease of carrying the bottle 102*a*. This gap 127 may enable a user to lift the beverage container 102*a* by grabbing the grip region 128 through the gap 127. In an embodiment, the gap 127 may be maximized in size because there is no encircling band material between the lateral regions 126. In an alternative embodiment, the band region 124 may encircle the entire neck 122, but optionally have a thinner portion facing the grip region 128 so as to maintain a larger gap 127. In an embodiment, the grip region 128 includes an outside surface and an inside surface, where the outside surface may have an angle between about 20° and about 60° relative to a longitudinal axis of the lateral regions 126. Although the handle 108 is shown to have a pair of lateral regions 126, it is also contemplated that one or more than two lateral regions may be utilized and provide for the same or similar functionality as provided by a pair of lateral regions 126. In the case of a single lateral region, the shape of the handle 108 may appear to be more of an "L" or "C" shape.

The lateral regions 126 may curve upwards by about 20 degrees to about 60 degrees toward the grip region 128. The curvature may have a radius of between about 5 mm and about 100 mm. The handle 108 may be made of any stiff material known in the art, such as acrylonitrile butadiene styrene, polycarbonates, polyamides, steel, and aluminum. Other materials, such as wood, silicone, rubber, thermoplastic elastomers, or other plastics, are also contemplated. In an embodiment, the handle is made of a material having a tensile strength between about 5 kilopounds per square inch (ksi) and about 80 ksi. By using a curve along the lateral regions 126, the handle 108 may provide the user with a sense that the bottle 102*a* is balanced at a natural angle.

Figure 2A:
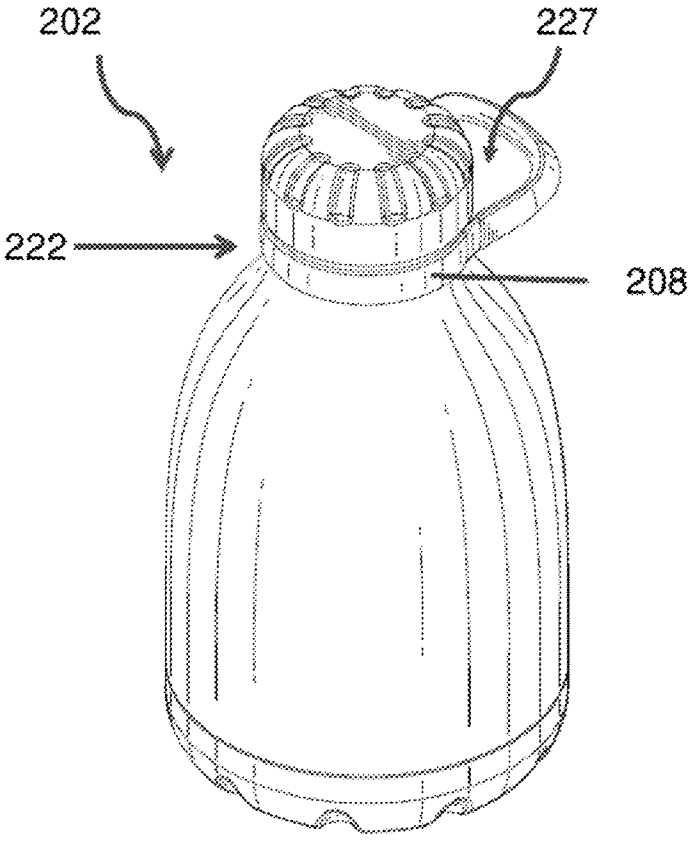
FIG. 2A is a perspective view illustration of an illustrative embodiment of a beverage bottle.
Figure 2B:
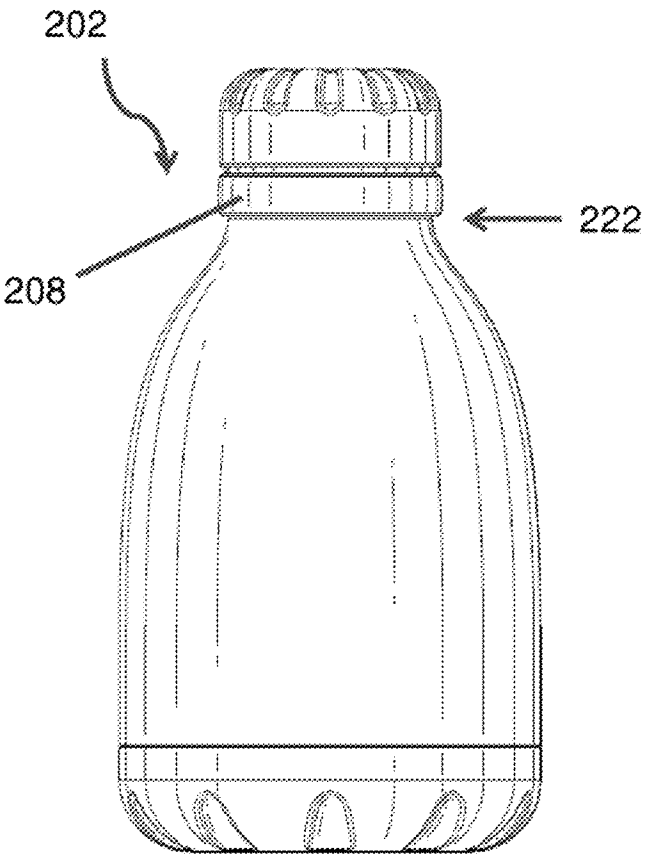
FIG. 2B is a rear elevational view illustration of the beverage bottle of FIG. 2A.
Figure 2C:
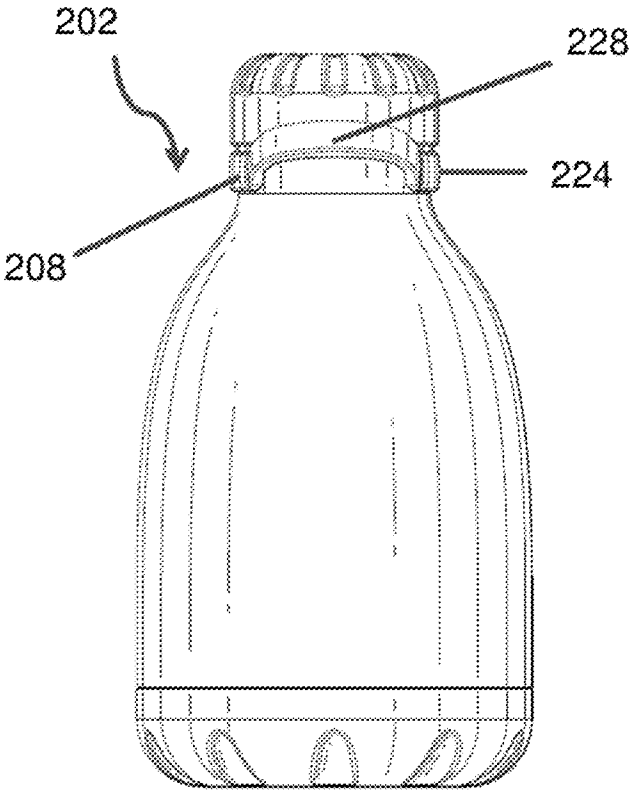
FIG. 2C is a front elevational view illustration of the beverage bottle of FIG. 2A.
Figure 2D:
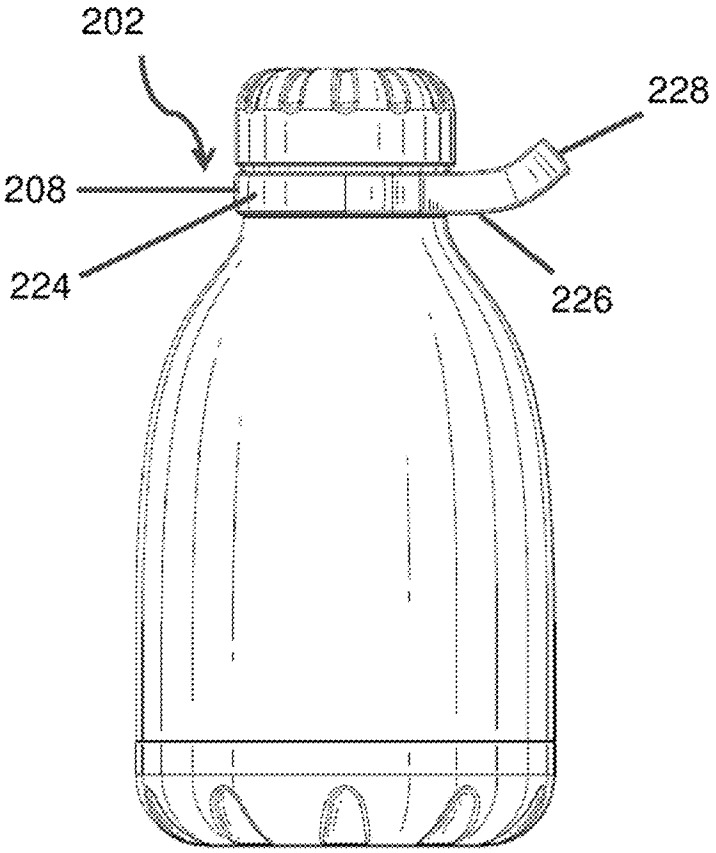
FIG. 2D is a left side elevational view illustration of the beverage bottle of FIG. 2A.
Figure 2E:
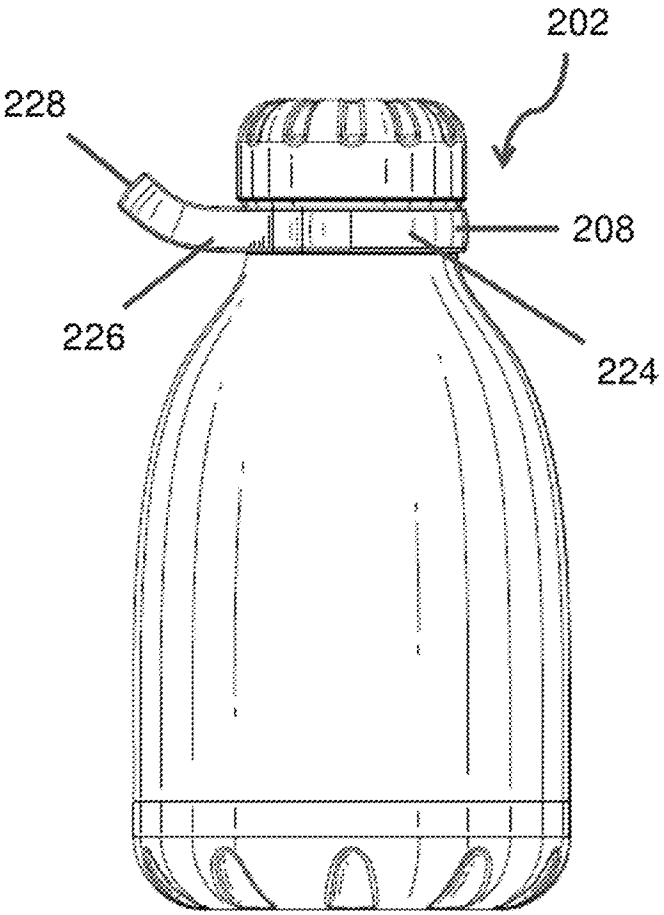
FIG. 2E is a right elevational side view illustration of the beverage bottle of FIG. 2A.
Figure 2F:
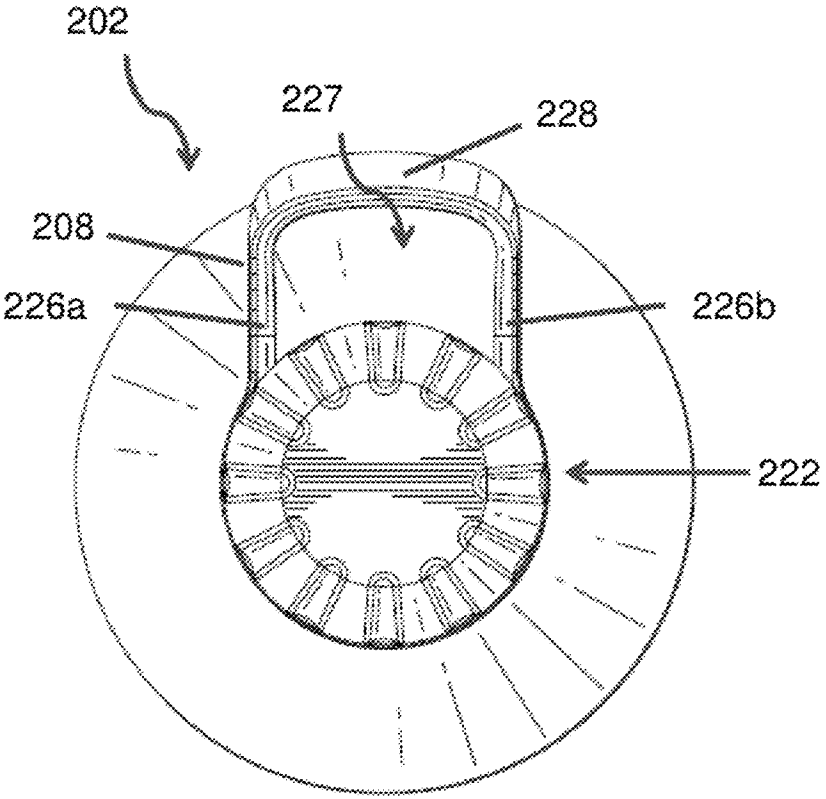
FIG. 2F is a top view illustration of the beverage bottle of FIG. 2A.
Figure 2G:
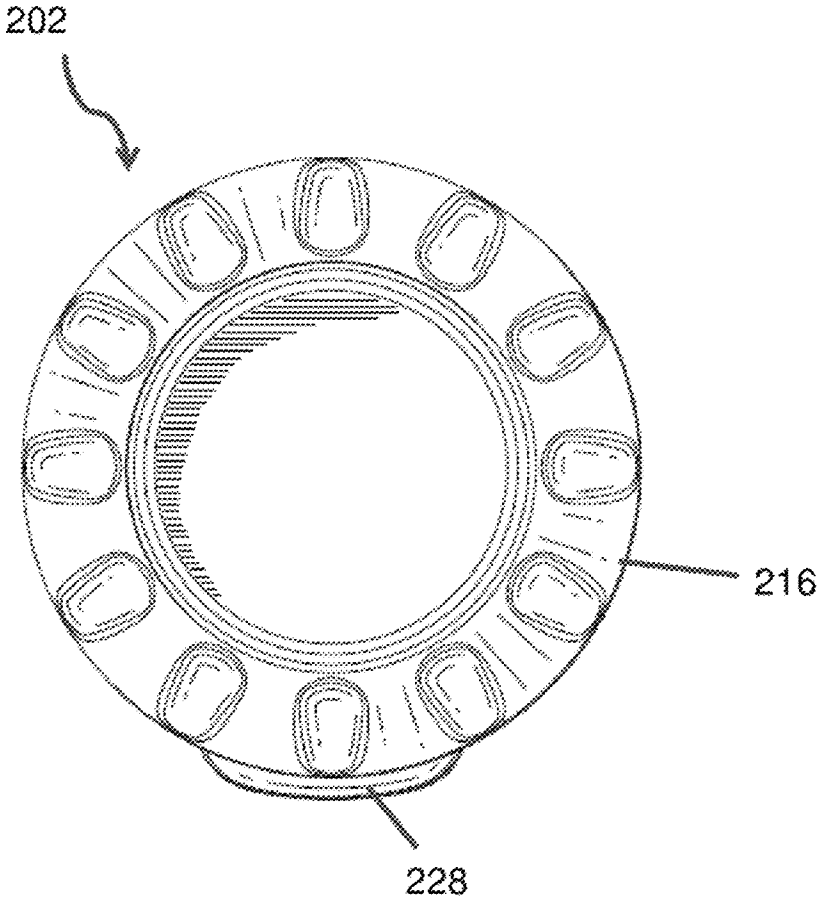
FIG. 2G is a bottom view illustration of the beverage bottle of FIG. 2A.

Referring to FIGS. 2A-2G, different views of a bottle 202 with a handle 208 are depicted. FIG. 2A is an illustration of a perspective view of the bottle 202 with the handle 208 secured to a neck 222 of the bottle 202. The handle 208 defines a gap 227 between the handle 208 and neck 222. FIG. 2B is an illustration of a rear view of the bottle 202 with the handle 208 secured to the neck 222. FIG. 2C is an illustration of a front view of the bottle 202 showing the handle 208 curving upward from a lateral region 226 that extends from the band region 224 to a grip region 228. FIG. 2D is an illustration of a left side view of the bottle 202 showing grip region 228 that is higher than a band region 224 of the handle 208. FIG. 2E is an illustration of a right side view of the bottle 202 showing the handle 208 curving upward from the lateral region 226. FIG. 2F is a top view of the bottle 202 showing lateral regions 226*a* and 226*b* of handle 208 extending from the band region 224 around the neck 222 of the bottle 202 so as to define a gap 227. The grip region 228 is curved to provide comfort to the user when gripping the handle 208 using his or her fingers. FIG. 2G is a bottom view of the bottle 202. In this embodiment, the grip region 228 extends beyond the outer dimensions of a sidewall 216 of the bottle 202. In alternative embodiments, the grip region 228 does not extend beyond the outer dimension of the bottle 202.

Figure 3A:
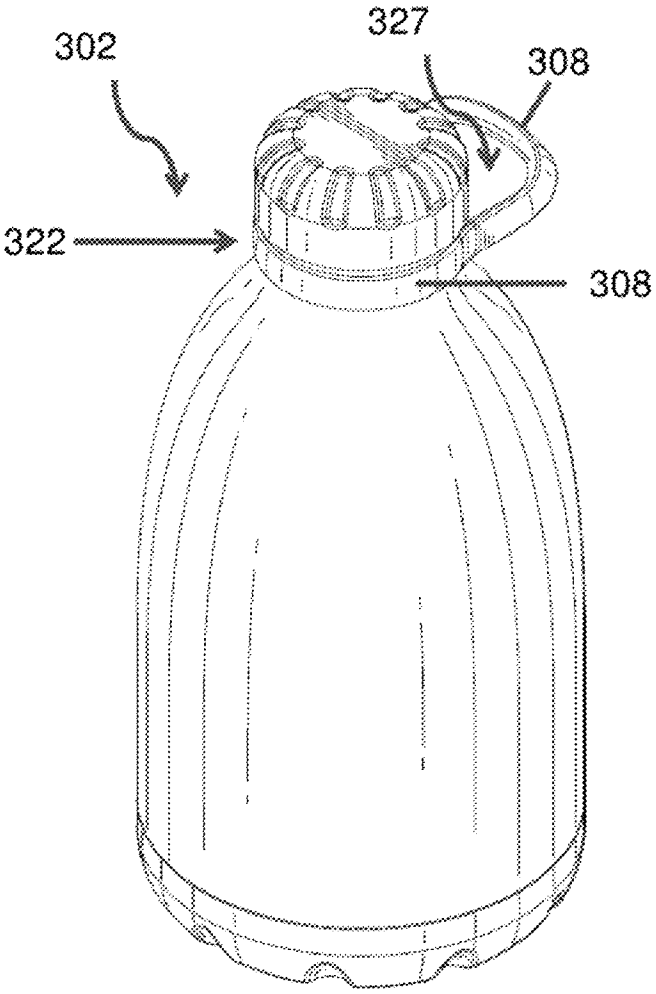
FIG. 3A is a perspective view illustration of an alternative embodiment of a beverage bottle with a handle.
Figure 3B:
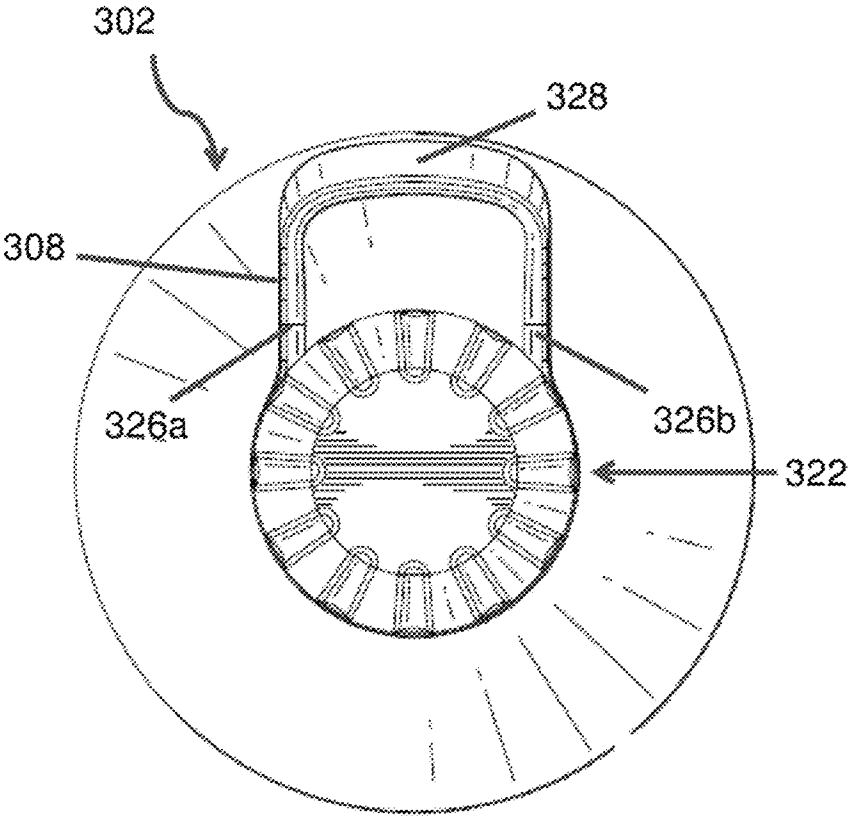
FIG. 3B is a top view illustration of the beverage bottle of FIG. 3A.

Referring to FIGS. 3A and 3B, illustrations of a bottle 302 with a handle 308 are depicted. The bottle 302 has different dimensions than the bottle 202 of FIGS. 2A-2G. FIG. 3A is an illustration of a perspective view of the bottle 302 with the handle 308 secured to a neck 322 of the bottle 302. A gap 327 as defined by the handle 308 is formed between a grip region 328 and neck 322. The grip region 328 may be angled toward the bottle 302 and have smooth surfaces so that a user carrying the bottle by the grip region 328 has a comfortable feeling and injury due to sharp edges to a user may be substantially avoided. FIG. 3B is an illustration of a top view of the bottle 202 with lateral regions 326*a* and 326*b* of handle 308 extending from a band region (not shown) partially encircling the neck 322. As shown, the grip region 328 does not extend beyond an outer dimension of a sidewall 316 of the bottle 302, thereby minimizing restriction or hindrance of axial movement of the bottle 302 when positioned in a carrier, such as a backpack.

Figure 4A:
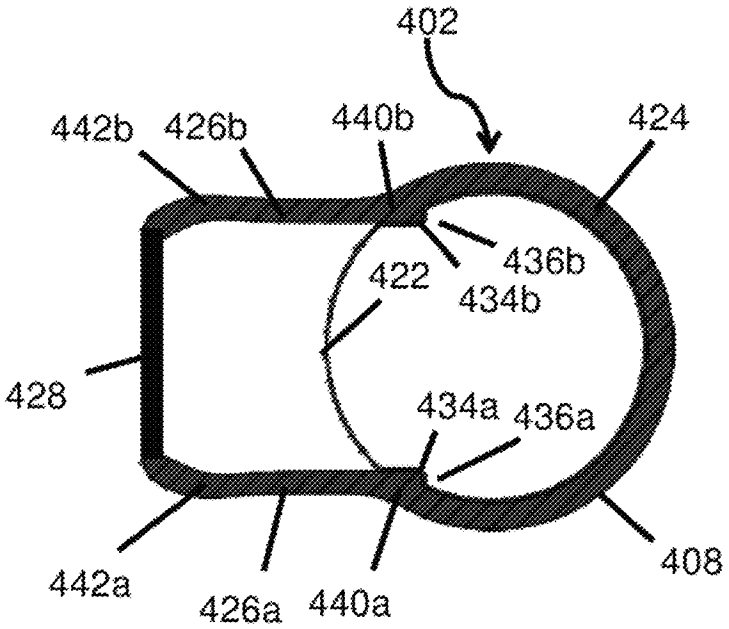
FIG. 4A is a top sectional view illustration of an illustrative handle of a beverage bottle.
Figure 4B:
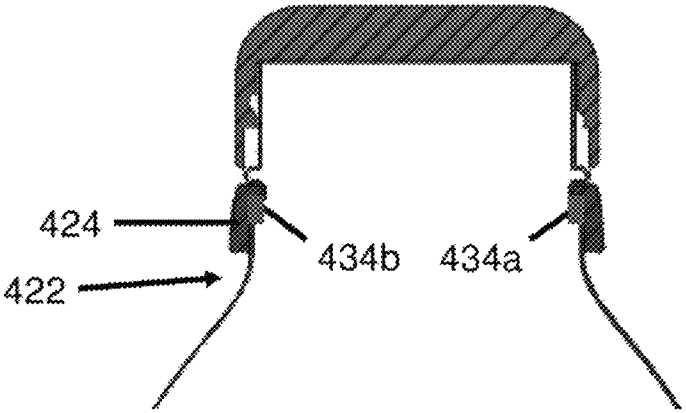
FIG. 4B is a side sectional view illustration of the handle of FIG. 4A.

Referring to FIGS. 4A and 4B, illustrations of a top sectional view and side sectional view of an illustrative handle 408 of a bottle 402 (e.g., bottle 302 of FIGS. 3A and 3B) are shown. Handle 408 may include a band region 424 configured to encircle a neck region 422 by about 270 degrees. Handle 408 may include one or more handle registration features 434*a* and 434*b* (collectively 434), which may be a protrusion from the handle 408. It should be understood that a wide variety of handle registration features may be utilized, including protrusions, indentations, demarcations, or otherwise. The handle registration feature(s) 434 may engage with a corresponding bottle registration feature(s) 436*a* and 436*b* (collectively 436) on the neck 422, where the corresponding registration feature may be an indentation that corresponds to the registration features 434 of the handle 408 so as to prevent the handle 408 from rotating around the neck 422. It should be understood that the handle and bottle registration features 434 and 436 may be reversed, such that the handle registration feature(s) 434 are indentation(s) and the corresponding bottle registration feature(s) 436 on the neck 422 are protrusion(s).

Figure 5B:
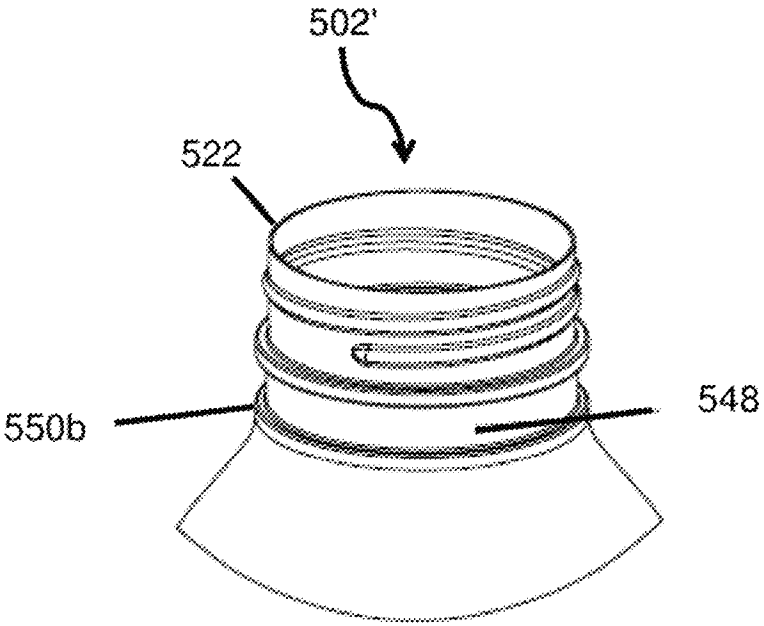
FIG. 5B is an illustration of an illustrative neck and finish of the beverage bottle of FIG. 5A includes a continuous groove on the neck in which the handle may be positioned.
Figure 5C:
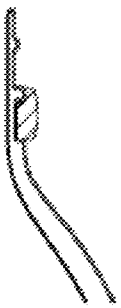
FIG. 5C is a cross-sectional view illustration of the neck and finish of the beverage bottle and handle engaged with the neck of the beverage bottle of FIGS. 5A and 5B.
Figure 5A:
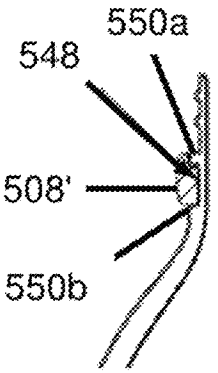
FIG. 5A is a top sectional view illustration of an alternative illustrative handle of a beverage bottle.
Figure 5A:
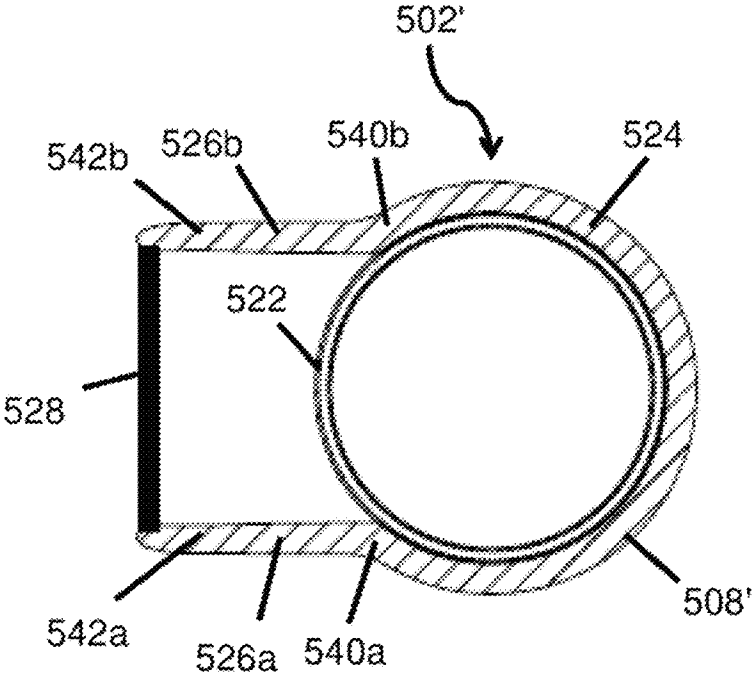

Referring to FIG. 5A, an illustration of a alternative bottle 502 and handle 508 that do not include registration feature(s). In this embodiment, rather than using registration features, a press-fit, adhesive, or other fastening means to prevent rotation may be utilized. Other portions of the bottle 502 and handle 508 may be the same or similar to those of the bottle 402 and handle 408 of FIG. 4A. In another embodiment, the handle may be allowed to rotate freely around the neck 522 of the bottle.

Handle 508 may also include a first set of transition points 540*a* and 540*b* (collectively 540), at which respective lateral regions 526*a* and 526*b* (collectively 526) of the band region 524 transition to extend radially from the band region 524 so as to extend from the neck 522. In an alternative embodiment, the lateral regions 526 may extend in lateral directions that are not in parallel. The lateral regions 526 may also extend from the band region 524 in non-lateral directions. It is understood that this transition may be a gradual and smooth transition, or a non-gradual and discontinous transition may be utilized. The lateral region 526 may include a second pair of transition points 542*a* and 542*b* (collectively 542), at which the lateral region 526 transitions from a lateral direction toward a longitudinal direction, so that the handle 508 starts converging to form a loop. It is understood that this second transition may be a gradual and smooth transition, or a non-gradual and discontinous transition. Curvature starting from the transition points 542 may have a radius that causes between about a 20 degree to about 60 degree curve toward a verticle angle. A grip region 528 connects the lateral region 526 from the second pair of transition points 542, so as to complete the loop. By the handle registration features 534 being perpendicularly aligned with the bottle registration features 536, if the handle 508 is pressed inward toward the bottle 502, then resistance of the bottle registration features 536 may operate to reduce or prevent the lateral regions 526 from spreading.

Referring to FIGS. 5B and 5C, an illustration of an illustrative neck and finish of the beverage bottle of FIG. 5A includes a continuous groove 548 on the neck 522 in which the handle 508 may be positioned is shown. The groove 548 may completely or partially, including one or more grooves, encircle the neck 522. The groove 548 may be defined by a first protrusion or ring 550*a* and a second protrusion or ring 550*b* formed in the neck 522. The groove 548 and/or protrusion(s) 550*a* and 550*b* may include one or more registration features (not shown). The handle 508 may be mounted and positioned within the groove 548, as described with regard to FIGS. 6A-6C.

Figures 6A, 6B, 6C:
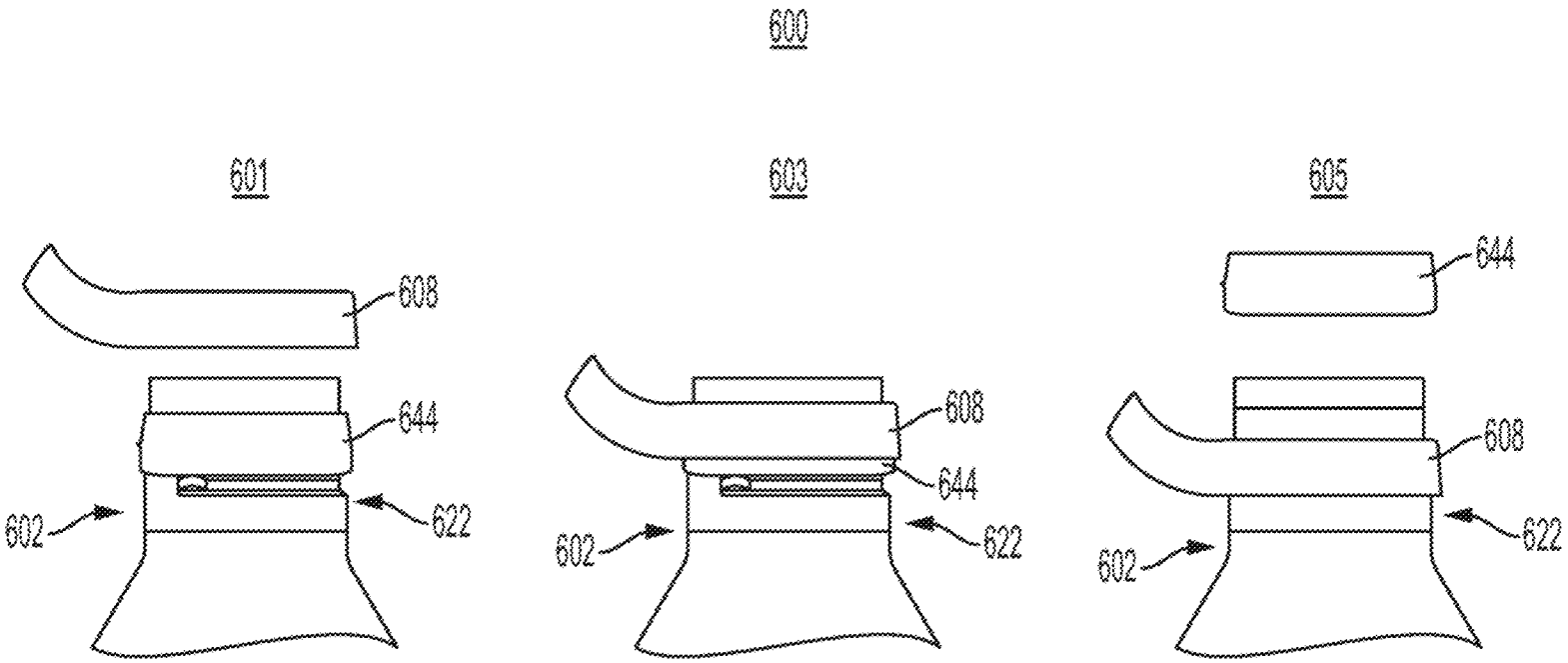
FIGS. 6A-6C are illustrations showing an illustrative sequence of a handle being assembled onto a bottle.

Referring to FIGS. 6A-6C, illustrations of an illustrative sequence 600 of a handle 608 being assembled onto a bottle 602 are shown. The sequence 600 is shown to include three steps 601, 603, and 605, but it should be understood that more or fewer steps may be performed. In step 601, a handle mounting member 644 may be placed over a finish portion 646 and/or neck 622 of the bottle 602. It is understood that the mounting member 644 may be made of any material, such as plastic, metal, and/or otherwise. The mounting member 644 may reduce or eliminate the potential to scratch the surface of the neck 622, which may be a bare material, painted, or enameled, and enable the handle 608 to be aligned with and mounted onto the neck 622 of the bottle 602. The handle 608 may be slid or placed over a the finish portion 646 toward the handle mounting member 644. In step 603, the handle 608 may be slid over the mounting member 644, which causes the handle 608 to spread. During the handle installation process, about 15 to about 25 pounds may be applied to the handle 608 (or to the bottle 602 if the handle 608 is maintained in a fixed position) to cause the handle 608 to extend over the handle mounting member 644 and be positioned onto the neck 622 of the bottle 602.

Step 603 may be performed by a machine or by hand in an automatic, semi-automatic, or manual manner. In step 605, after the handle 608 extends past the handle mounting member 644, the handle mounting member 644 may be removed from the neck 622, thereby leaving the handle 608 engaged to the neck 622. As previously shown in FIGS. 5A and 5B, the handle 608 and neck 622 may have registration features (not shown in FIGS. 6A-6C) that restrict or prevent the handle 608 from rotating around the neck 622 of the bottle 602. In an embodiment, the handle 608 may be additionally secured to the neck 622 using well-known attachment techniques, including using adhesives (e.g, glues, epoxies, etc.), connection members (e.g., screws), or otherwise.

In an alternative embodiment, the handle 608, due to the open loop design, may be flexible enough to be momentarily expanded and snapped onto the neck 622 or into a groove or partial groove in the neck, with either manual or machine assisted high force expansion of the handle loop. In such an embodiment, the process 600 may be performed without the handle mounting member 644. The handle 608 may be configured to be secured to the neck 622 of the bottle 602 by an inward force of the handle 608. Alternatively, an adhesive may be utilized to secure the handle 608 to the neck 622 of the bottle 602.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The previous description is of a preferred embodiment for implementing the invention, and the scope of the invention should not necessarily be limited by this description. The scope of the present invention is instead defined by the following claims.

What is claimed:

1. A beverage container, comprising:

a first end defining a base;

a second end defining an opening;

a sidewall extending between said first end and second end;

a neck disposed between said sidewall and second end;

a handle including:

a. a band region that encircles said neck less than 360° and terminates at a first pair of transition points;

b. a first lateral region and a second lateral region that respectively extend outwardly from the first pair of transition points away from the neck and towards a second pair of transition points; and c. a grip region extending from and between the second pair of transition points so as to connect the first and second lateral regions, wherein the second pair of transition points curves upwards at an angle from the first and second lateral regions and towards the grip region;

wherein (i) the band region is fixedly positioned relative to the first lateral region, the second lateral region, and the grip region, (ii) the first lateral region and the second lateral region are each fixedly positioned relative to the band region and the grip region, and (iii) the grip region is fixedly positioned relative to the band region, the first lateral region, and the second lateral region.

2. The container according to claim 1, wherein said neck and said band region define complementary registration features.

3. The container according to claim 2, wherein a registration feature defined by said neck is an indentation.

4. The container according to claim 2, wherein a registration feature defined by said neck is a protrusion.

5. The container according to claim 2, wherein the registration feature defined by said neck further includes first and second dimples, and the registration feature defined by said band region further includes first and second notches, the first dimple and first notch being approximately collinear with said first lateral region and said second dimple and second notch being approximately collinear with said second lateral region.

6. The container according to claim 1, said container further comprising an adhesive that secures said band region to said neck.

7. The container according to claim 1, wherein said band region encircles said neck greater than about 180° and less than about 330°.

8. The container according to claim 7, wherein said band region encircles said neck by about 270°.

9. The container according to claim 1, wherein said grip region includes an outside surface and an inside surface, the outside surface having an angle between about 20° and about 60° relative to a longitudinal axis of said lateral regions.

10. The container according to claim 1, wherein the transition at said first pair of transition points is an arc shape.

11. The container according to claim 1, wherein said lateral regions are in parallel with each other.

12. The container according to claim 1, wherein material used to form said handle is selected from a group consisting of acrylonitrile butadiene styrene, polycarbonates, polyamides, rubber, silicone, thermoplastic elastomer, wood, steel, and aluminum.

13. The container according to claim 1, wherein said handle is made of a material having a tensile strength between about 5 pounds per square inch (ksi) and about 80 ksi.

14. The container according to claim 1, wherein said band region has a height between about 3 millimeters and about 50 millimeters.

15. The container according to claim 1, wherein said band region has a thickness between about 2 millimeters and about 10 millimeters.

16. The container according to claim 1, wherein said sidewall has a first diameter, and wherein said lateral regions and grip region combined have a length less than the first diameter of said sidewall.

17. The container according to claim 1, wherein said handle is formed of a uniform material.

18. The beverage container according to claim 1, wherein the handle snap-fits onto the neck of the beverage container.

19. The beverage container according to claim 1, wherein the neck includes a groove that encircles the neck and is sized and shaped to receive a protrusion on the band region of the handle.

20. The beverage container according to claim 1, wherein the angle is between about 20 degrees and about 60 degrees.

21. A handle for a beverage container, comprising:

a. a band region configured to encircle a neck of the beverage container less than 360°, said band region terminating at a first pair of transition points;

b. first and second lateral regions that each extend outwardly from the first pair of transition points away from said band region and towards a second pair of transition points; and c. a grip region extending from and between the second pair of transition points so as to connect said first and second lateral regions, wherein the second pair of transition points curves upwards at an angle from the first and second lateral regions and towards the grip region;

wherein (i) the band region is fixedly positioned relative to the first lateral region, the second lateral region, and the grip region, (ii) the first lateral region and the second lateral region are each fixedly positioned relative to the band region and the grip region, and (iii) the grip region is fixedly positioned relative to the band region, the first lateral region, and the second lateral region.

22. The handle according to claim 21, wherein said band region further defines a registration feature that is complementary registration feature on the neck of the beverage container.

23. The handle according to claim 22, wherein the registration feature of said band region is a protrusion.

24. The handle according to claim 21, wherein the transition at the first pair of transition points is an arc shape.

25. The handle according to claim 21, wherein the handle does not extend beyond an outermost dimension of the beverage container when coupled to the neck of the beverage container.

26. The handle according to claim 21, where the band region, first and second lateral regions, and grip region are formed integrally.

27. The beverage container according to claim 21, wherein the angle is between about 20 degrees and about 60 degrees.

* * * * *